US005687781A

United States Patent [19]

Grizz

[11] Patent Number: 5,687,781

[45] Date of Patent: Nov. 18, 1997

[54] SAND BAG FILLING DEVICE

[76] Inventor: Anthony J. Grizz, P.O. Box 532, Clearlake Park, Calif. 95424

[21] Appl. No.: 621,296

[22] Filed: Mar. 22, 1996

[51] Int. Cl.[6] ..... B65B 67/00

[52] U.S. Cl. ..... 141/316; 141/108; 141/390; 141/391; 294/55

[58] Field of Search ..... 141/108, 109, 141/314, 316, 390, 391; 248/97, 99; 294/55

[56] References Cited

U.S. PATENT DOCUMENTS

| | | | |
|---|---|---|---|
| 191,502 | 5/1877 | Wing | 141/390 X |
| 1,234,057 | 7/1917 | McIntyre . | |
| 1,266,522 | 5/1918 | Oldham | 141/108 |
| 1,439,878 | 12/1922 | Erhardt et al. . | |
| 1,909,670 | 5/1933 | Evans | 141/314 X |
| 2,269,257 | 1/1942 | Edwards | 248/147 |
| 2,622,780 | 12/1952 | Ackerman | 141/314 X |
| 2,958,252 | 11/1960 | Curtis | 87/33 |
| 4,044,921 | 8/1977 | Caverly | 222/74 |
| 5,014,943 | 5/1991 | Nelson et al. | 248/99 |
| 5,121,775 | 6/1992 | McClain | 141/83 |
| 5,353,851 | 10/1994 | Cline | 141/256 |
| 5,397,085 | 3/1995 | Spagnolo | 248/97 |

*Primary Examiner*—J. Casimer Jacyna
*Attorney, Agent, or Firm*—Bielen, Peterson & Lampe

[57] ABSTRACT

A sandbag filling device utilizing a scoop possessing first and second end portions. A channel is formed intermediate the first and second end portions and is sized to allow a bag to fit over the scoop. A support is also employed and includes a first portion pivotally engaging the scoop. The support also possesses a second portion which includes a flange that extends transversely from the support. The flange may sere as a stop for the closed portion of the bag that fits over the scoop when the bag is being filled.

8 Claims, 3 Drawing Sheets

SAND BAG FILLING DEVICE

BACKGROUND OF THE INVENTION

In accordance with the present invention a novel and useful device for filling a bag with material such as gravel, sand, and the like is herein provided.

Filling bags with materials such as sand, is often tedious and difficult task. In certain emergency cases, sandbags must be used to buttress a levy or watercourse to prevent flooding damage. When this occurs, it is important that sandbags be filled quickly and efficiently.

In the past, systems have been devised to aid the filling of sacks and support soft items such as bags and ropes. For example, U.S. Pat. Nos. 2,269,257 and 2,958,252 describe such structures to generally support containers and the like in a vertical position.

U.S. Pat. Nos. 4,044,921; 5,121,775; and 5,353,851 describe material filling apparatuses which employ conveyors, augers, and hoppers for filling containers such as sand bags. The system described in these patents generally use equipment operated by motorized means.

U.S. Pat. Nos. 1,439,878 and 5,397,085 show bag or sack filling aids which include ring-like members to hold open the sacks and stands to help support the same in a vertical position. The latter patent also includes a generally upwardly extending chute to aid in the filling of the sack.

U.S. Pat. No. 1,234,057 describes a combined scoop and sack filler in which a scooper is connected on one end and opens to a sack on the other end. The sack is connected to the scoop by hooks and would be detached therefrom when the bag is filled. One using the device of the '057 patent would also be required to support the bottom of the sack in some manner when it is being used.

A device for filling bags with material such as sand quickly and easily while maintaining the support of the bag during the filling process would be a notable advance in the material transport field.

SUMMARY OF THE INVENTION

In accordance with the present invention a novel and useful bag filling device is herein provided.

The device of the present invention utilizes a scoop having a first end portion and a second end portion with a channel formed intermediate the first and second end portions. The scoop may be constructed of any rigid or semi-rigid material such as metal, plastic, wood, and the like. The scoop is formed with a mouth at the first end portion which may be wider than the exit at the second end portion of the scoop. The scoop is generally shaped to allow a bag to fit over its second end portion and along its intermediate portion toward the mouth thereof. The scoop may include apertures to allow the manipulation of the same during its use.

The device of the present invention also includes a support that has a first portion that pivotally engages the scoop. In addition, the support is formed with a flange that extends outwardly therefrom at the second end portion thereof. The outwardly extending flange may underlie the second end portion of the scoop and to serve as a support when the bag fits over the scoop for filling with material such as sand. In addition, the flange may be provided with a grip for the hand to aid in the holding of the bag covered scoop and the attached support. When the flange is placed along a ground surface, the bag covered scoop may rotate about the pivotal connection at the first end portion of the scoop such that the scoop and bag are generally vertically oriented. In addition, the rotation of the second end portion of the scoop and bag away from the flange of the support permits the bag to be removed from the scoop either before or after the bag is filled with material.

The grip found on the flange may accompany a second grip in the form of a bar across the scoop. Such bar would be connected to the scoop near the first end portion thereof and immediately adjacent the pivot point of the stand relative to the scoop. Lifting of the combined scoop and stand by the pair of grips allows the user to manipulate the device of the present invention to fill a sand bag.

In accordance with the present invention a novel and useful device for filling bags with material has been described.

It is thereof an object of the present invention to provide a device for filling bags with material which combines the use of a relatively rigid scoop to fill a flexible bag quickly and easily.

It is another object of the present invention to provide a device for filling bags with material which operates manually without the use of motorized elements and is extremely efficient in operation.

Yet another object of the present invention is to provide a device for filling bags with material that may be operated by a single person and fill bags with material at a rate comparable to prior systems employing two persons.

A further object of the present invention is to provide a device for filling bags with material that is relatively simple to manufacture and maintain.

The invention possesses other objects and advantages especially as concerns particular characteristics and features thereof which will become apparent as the specification continues.

For a better understanding of the invention reference is made to the following detailed description of the preferred embodiments thereof which should be taken in conjunction with the prior described drawings.

DETAILED DESCRIPTION OF THE PREFERRED EMBODIMENTS

Various aspects of the present invention will evolve from the following detailed description of the preferred embodiments thereof which should be taken in conjunction with the prior described drawings.

Figure 4:
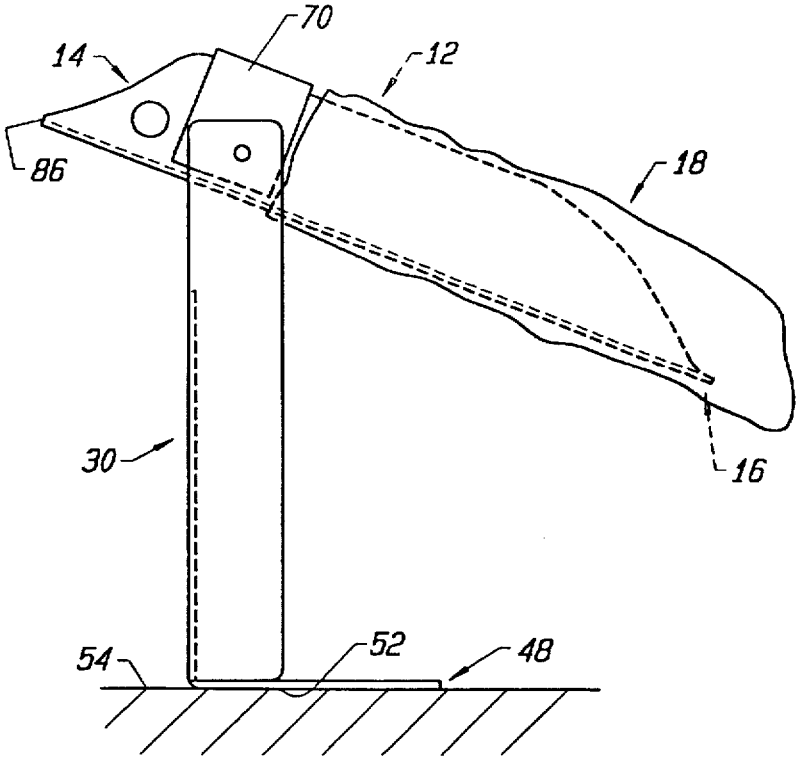
FIG. 4 is a side elevational view of the device of the present invention in which the scoop as positioned in FIG. 3 is partially overlain with a bag.

The invention as a whole is depicted in drawings by reference character 10. The sand bag filling device 10 includes as one of its elements a scoop 12 having a first end portion 14 and a second end portion 16. Scoop 12 is sized to accommodate the fitting of a bag or sack 18 thereover. With reference to FIG. 4, it may be observed that bag 18 has been slipped over second end portion 16 of scoop 12 and extended toward first end portion 14 of scoop 12. In this regard, wall portions 20 and 22 of scoop 12 extend upwardly in order to provide a good fit of bag 18 over scoop 12. Wall portions 20 and 22 of scoop 12 also form channel 24 which extends between first end portion 14 of scoop 12 and second end portion 16. Finger openings 26 and 28 through wall portions 20 and 22, respectively, aid the user in positioning scoop 12 while in use, which will be described in greater detail hereinafter.

Figure 1:
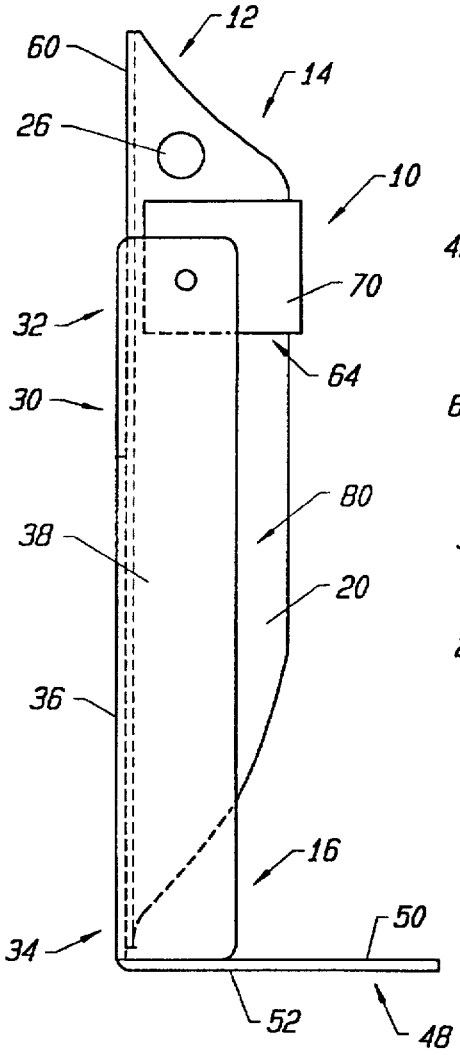
FIG. 1 is a side elevational view of the device in an upright position.
Figure 2:
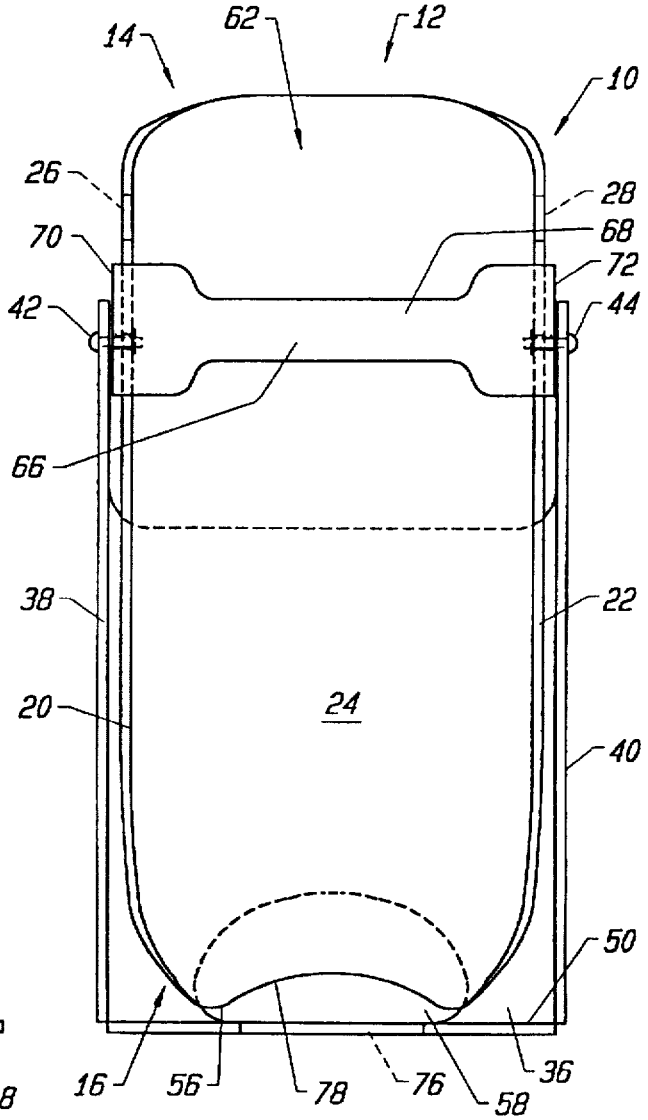
FIG. 2 is a front elevational view of the device of the present invention in an upright position.

Device 10 also includes a stand 30 having a first portion 32 and a second portion 34. Stand 30 also includes a base 36 and outwardly extending wall portions 38 and 40. Stand 30 pivotally attaches to scoop 12 by the use of pivot pins 40 an 42 and 44 which pass through wall portions 38 and 40, respectively, as well as walls 20 and 22 of scoop 12, FIG. 2. Thus, the scoop is rotatable outwardly from or inwardly toward base 36 of stand 30, FIGS. 3–5, specifically directional arrow 46 of FIG. 3.

Figure 3:
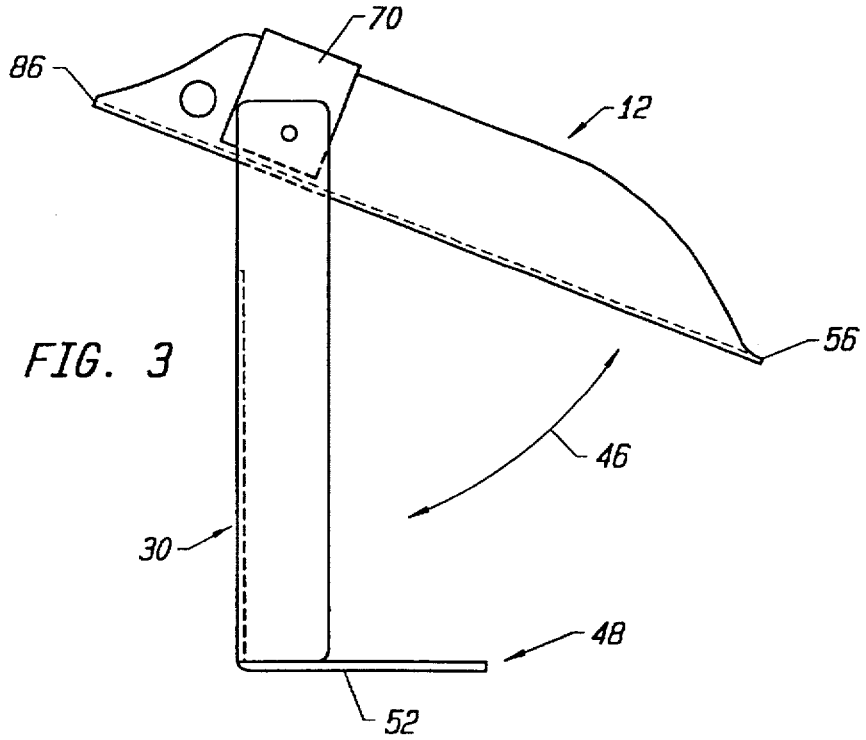
FIG. 3 is a side elevational view of the device of the present invention in which the scoop portion has been rotated upwardly.
Figure 5:
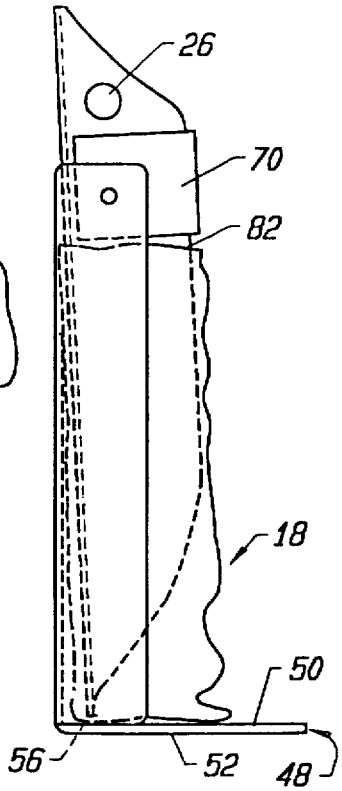
FIG. 5 is a side elevational view of the device of the present invention in which the bag and scoop of FIG. 4 has been rotated downwardly.

Flange 48 extends from second portion 34 of stand 30 transversely relative to base 36. In the embodiment depicted in the drawings, flange 48 is substantially orthogonal relative to base 36. It should be understood that flange 48 may extend outwardly at other angular configurations. In any case, it is intended that flange 48 extend outwardly to underlie wall portions 20 and 22, as well as channel 24, of scoop 12. Flange 48 includes an upper surface 50 and a lower surface 52. With reference to FIGS. 3–5, it may observed that lower surface 52 is capable of contacting ground surface 54, which aids in the support of device 10 during use. Moreover, with reference to FIG. 5, it may be seen that bag 18 is capable of contacting upper surface 50 of flange 48 and is held in place at the closed end thereof between upper surface of flange 48 and edge 56 of scoop 12.

Opening 58 through base 36 of stand 30 serves as an entry for the foot of the user to help steady device 10 while in use. Also, the user's foot may extend through opening 58 to push rear surface 60 of scoop 12 and initiate in the rotation of the scoop 12 relative to stand 30.

Gripping means 62 is also depicted in the drawings and includes a C-shaped member 64 which extends over channel 28 and down the sides of walls 20 and 22 of scoop 12. Bar 66 having a central reduced portion 68 spans walls 20 and 22 of scoop 12. Bar 66, may also be constructed with an outwardly arched central portion to expand the depth and the substance carrying capacity of channel 24. Also, bar 66 may possess a knurled surface to aid in the gripping of the same. Legs 70 and 72 of bar 66 extend downwardly along walls 20 and 22, respectively. Pins 40 and 42 hold legs 70 and 72 to scoop 12 such that bar 66 rotates with scoop 12 relative to stand 30.

Gripping means 74 is also encompassed by the filling device 10 of the present invention. Gripping means 74 takes the form of an opening 76 through flange 48. Thus, the user is able to place one hand through opening 76 and the other on reduced portion 68 of bar 66 when holding filling device 10.

Figure 6:
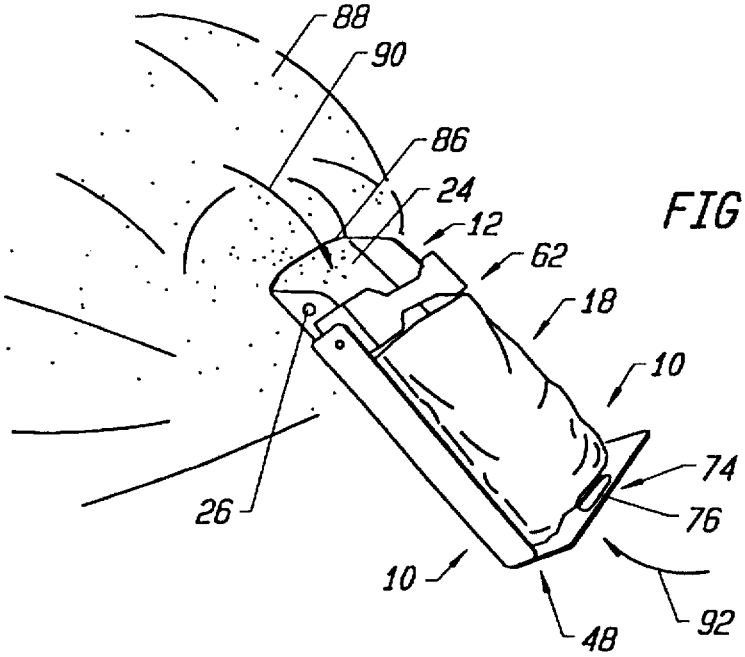
FIG. 6 is a top right perspective view of the device in use with a sand heap.
Figure 7:
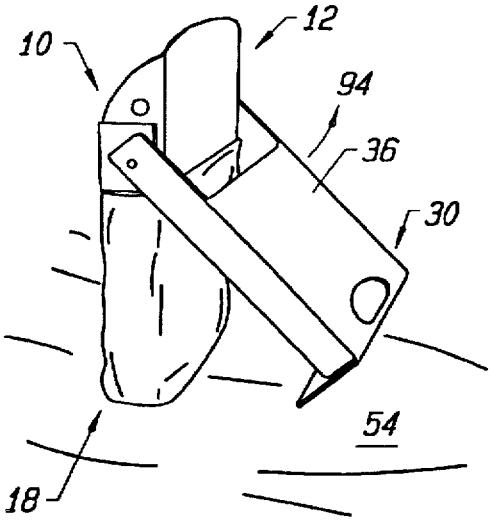
FIG. 7 is a top right perspective view showing the device in which the stand portion has been rotated upwardly therefrom after filling with sand.
Figure 8:
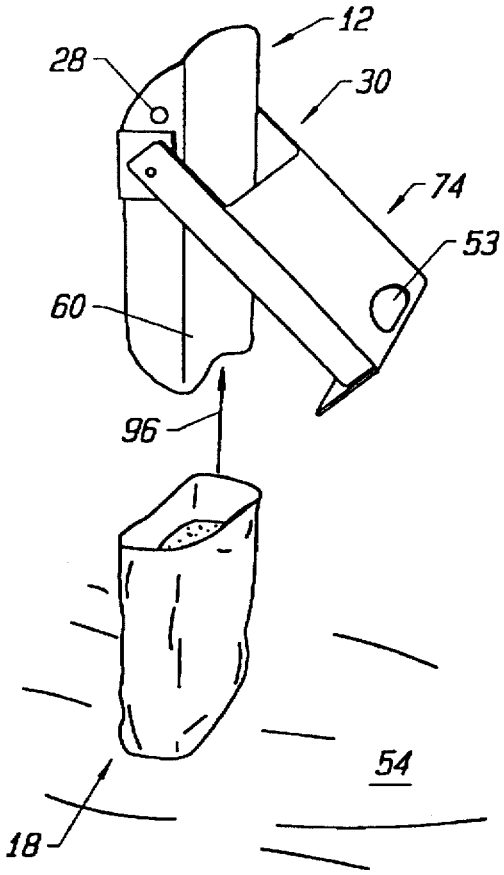
FIG. 8 is a top right perspective view showing removal of a filled bag from the device of the present invention.

In operation, the user rotates scoop 12 relative to stand 30, per directional arrow 46 of FIG. 3. Opening 58 may be employed to accommodate the user's foot to hold flange 48 downwardly by the application of pressure on upper surface 58 thereof. Also, the user's foot may apply a kicking force or push on scoop 12 when it is in the position depicted in FIGS. 3–5. Edge 56 of scoop 12 includes a recess 78 to permit the user's foot to extend onto surface 50 of flange 48, in this regard. With reference to FIG. 4, it may be apparent that bag 18 is slipped over scoop 12, second end portion 16, and intermediate portion 80. Bag 18 would extend as far as bar 66. However, edge portion 82 of bag 18 may be pulled to bar 66 and held when the user grips bar 66 during use. Scoop 12 and bag 18 are then rotated downwardly such that bag lies between edge 56 of scoop 12 and the upper surface 50 of flange 48, FIG. 5. The user's other hand is then placed within opening 76 in order to pull upwardly on flange 48. Device 10 may be transported in this position for use. Turning to FIG. 6, it may be seen that device 10 is being operated such that scoop 12 leading edge 86 is engaging a pile of sand 88. Directional arrow 90 indicates that sand is passing from pile 88 into channel 24 of scoop 12 and into bag 18. Gripping means 62 and 74 are employed by the user at this time such that a force is applied to filling device 10 toward sand pile 88, as indicated by directional arrow 92. Sand entering bag 80 is steadied by flange 48. Flange 98 also tends to keep bag 18 over scoop 12 during this process. When bag 18 is filled, FIG. 7, device 10 is rotated such that bag 18 lies on ground surface 54 and stand 30 is rotated upwardly as depicted by directional arrow 94. Device 10 is then lifted from bag 18, FIG. 8, by the use of gripping means 62, 74, and optional finger openings 26 and 28. Directional arrow 96 indicates the movement of device 10 relative to bag 18 on FIG. 8. Bag 18 is then sealed and used as desired. Device 10 is then reloaded with another bag and is used again in the same manner as described herein before. Device 10 has been found to greatly save time and labor in filling bags such as bag 18 with material such as sand.

While in the foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. A device for filling a bag with material comprising:

a. a scoop having a first end portion, a second end portion and a channel formed by an intermediate portion between said first and second end portions, said scoop being sized to allow the bag to fit over the scoop and to bear on said intermediate portions; and b. a support, said support including a first portion and a second portion connected to and extending from said first portion, said support first portion pivotally engaging said scoop, said support further possessing a flange connected to and extending from said second portion of said support in the vicinity of said channel of said scoop, said pivotal engagement of said support first portion to said scoop permitting said second portion of said support and said connected flange to selectively move from a first position in which said flange extends transversely relative to said channel of said scoop intermediate portion, and to a second position in which said support flange lies apart from said channel formed by said intermediate portion of said scoop, the bag being removable from said scoop when said second portion of said support and said connected flange are in said second position;

said device being designed to be in a substantially vertical position when in said second position, and when in said first position, said device being designed to be tilted away from said vertical position toward a horizontal position with the first end portion of said scoop being adapted to engage said material and to scoop said material into said bag.

2. The device of claim 1 in which said support further comprises gripping means to allow the application of a rotational force between said scoop and said support.

3. The device of claim 2 in which said gripping means comprises a handhold on said support flange.

4. The device of claim 3 in which said handhold comprises a recess in said flange.

5. The device of claim 1 in which said gripping means is a first gripping means and said device further comprises second gripping means on said scoop.

6. The device of claim 5 in which said second gripping means includes a bar spanning said scoop.

7. The device of claim 1 in which said support flange includes an edge portion capable of contacting a ground surface to maintain said scoop in an upright position with said scoop first portion positioned above said scoop second end portion.

8. The device of claim 1 in which said scoop first portion includes a mouth.

* * * * *